US006036517A

United States Patent [19]

Byrne

[11] Patent Number: 6,036,517

[45] **Date of Patent: *Mar. 14, 2000**

[54] JUNCTION BLOCK WALL MOUNTING ARRANGEMENT

[76] Inventor: Norman R. Byrne, 2736 Honey Creek, NE., Ada, Mich. 49301

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,000

[22] Filed: Jan. 15, 1997

Related U.S. Application Data

[60] Provisional application No. 60/010,142, Jan. 17, 1996.

[51] Int. Cl.[7] ..... H01R 25/00

[52] U.S. Cl. ..... 439/215; 439/573

[58] Field of Search ..... 439/215, 342, 439/343, 571, 573

[56] References Cited

U.S. PATENT DOCUMENTS

| | | | |
|---|---|---|---|
| 4,959,021 | 9/1990 | Byrne . | |
| 4,993,576 | 2/1991 | Byrne | 220/3.9 |
| 5,013,252 | 5/1991 | Nienhuis et al. | 439/215 |
| 5,178,555 | 1/1993 | Kilpatrick et al. | 439/215 |
| 5,203,712 | 4/1993 | Kilpatrick et al. | 439/215 |
| 5,259,787 | 11/1993 | Byrne | 439/557 |

*Primary Examiner*—Gary F. Paumen
*Attorney, Agent, or Firm*—Varnum, Riddering, Schmidt & Howlett LLP

[57] ABSTRACT

A mounting system for attaching a junction block to a surface includes a mounting block having a base for connection to one of the sides of a junction block and a mounting portion attached to and extending away from the base for installing the mounting block on the surface. The junction block sides are configured to receive modular electrical receptacles. The mounting system is attached to the side of the junction block that faces the surface. The mounting portion of the mounting block comprises a wall that is integrally formed with the base. The wall includes one or more apertures sized to receive fasteners for mounting the block to the surface. In an alternative embodiment, a mounting bracket is provided for attachment between the surface and the mounting portion of the mounting block. The mounting bracket includes a bracket wall with first and second spaced-apart support brackets and a retaining tab extending from the wall. The retaining tab is positioned between the first and second support brackets. The mounting portion of the mounting block also has first and second spaced-apart attachment lugs extending rearwardly of the base for slidably engaging the first and second support brackets, respectively. A pair of opposing interlocking movable latch members are hingedly attached to the base and define a channel therebetween for receiving the retaining tab in locking engagement. Each of the interlocking latch members is operable to disengage both of the latch members from the retaining tab in response to an external force on either of the latch members.

25 Claims, 6 Drawing Sheets

JUNCTION BLOCK WALL MOUNTING ARRANGEMENT

This application claims the benefit of U.S. Provisional Application No. 60/010,142 filed on Jan. 17, 1996.

BACKGROUND OF THE INVENTION

1. Field of the Invention

The invention pertains to electrical interconnection systems and more particularly to a mounting arrangement for such systems in the distribution of electrical power to modular wall panels or the like.

2. Prior Art

Known interior wall systems typically employ prefabricated modular wall units which are joined together in various configurations to divide a work space into smaller offices or work areas. Generally, such modular wall panels are equipped with raceways, for example along a bottom edge of the modular panels, for housing electrical cabling and junction blocks in order to provide electrical outlets and electrical power connections to adjacent panels. The raceways and junction blocks typically have a mechanical mounting system for securing the junction blocks to the raceways, such that the junction blocks depend downwardly from the top of the raceways. The raceway of a modular wall unit may be provided with a pair of junction blocks having electrical outlets, disposed at spaced-apart positions along the raceway. Conduits, extending between the junction blocks, provide electrical interconnection between these units. A typical wall panel mounting system is described in my U.S. Pat. No. 4,993,576, which is herein incorporated by reference.

When it is desired to provide electrical outlets to other locations not associated in particular with modular wall units, such as along a vertically oriented surfaces of walls or office furniture, the junction block mounting system for wall panel raceways does not provide any means for attaching the junction blocks thereto. Current junction block mounting systems only permit attachment of the junction block along its upper horizontal surface.

SUMMARY OF THE INVENTION

These and other problems of the prior art are overcome by means of a mounting system for attaching junction blocks along a vertical wall. According to one aspect of the invention, a junction block having duplicate sides is provided. One side of the junction block receives a modular outlet, while the other side receives a mounting assembly for securing the junction block to a vertical surface.

According to one embodiment of the invention, the mounting assembly is first secured to the vertical surface and the junction block is subsequently attached to the mounting assembly.

According to another embodiment of the invention, the mounting assembly is arranged in two components. The first component is secured to a vertical surface, and the second component interfaces between the junction block and the first component for securing the junction block to the vertical surface.

According to one aspect of the invention, an electrical interconnection assembly for attachment to a surface, such as a vertical or horizontal wall, comprises one or more junction blocks having duplicate opposing sides for receiving modular electrical receptacles, mounting assembly adapted to be secured to the surface; and a modular electrical receptacle. One side of the junction block receives the modular receptacle, while the opposing side receives the mounting assembly. The mounting assembly preferably includes a mounting block with a base for connection to the junction block and a mounting portion attached to and extending away from the base for installing the mounting block on the surface. The modular electrical receptacle also comprises a base that is similar in construction to the mounting block base for connection to the junction block. A receptacle portion is attached to and extends away from the receptacle base for receiving an electrical plug from an electrically powered device.

According to one embodiment of the invention, the mounting portion of the mounting block comprises a wall that is integrally formed with the base. The wall includes one or more apertures sized to receive fasteners for mounting the block to the surface.

According to a further embodiment, a mounting bracket is provided for attachment between the surface and the mounting portion of the mounting block. Preferably, the mounting bracket comprises a bracket wall with first and second spaced-apart support brackets and a retaining tab extending therefrom, the retaining tab being positioned between the first and second support brackets. The mounting portion of the mounting block comprises first and second spaced-apart attachment lugs extending rearwardly of the base for slidably engaging the first and second support brackets, respectively; and a pair of opposing interlocking movable latch members hingedly attached to the base and defining therebetween a channel for receiving the retaining tab. Each of the interlocking latch members is operable to disengage both of the latch members from the retaining tab in response to an external force on either of the latch members. In this manner, the retaining tab is disengaged from the latch members by operation of either latch member to allow sliding movement of the mounting block with respect to the mounting bracket, for installing the block to the bracket or removing the block from the bracket. The bracket wall has one or more apertures sized to receive fasteners for mounting the bracket to the surface.

According to a further aspect of the invention, a mounting system is provided for attaching a junction block to a surface. The junction block has a top wall, a bottom wall, and duplicate opposing sides extending between the top and bottom walls. Each of the opposing sides is adapted to lockably receive modular electrical receptacles. The mounting system includes a mounting block having a base for connection to one of the junction block opposing sides and a mounting portion attached to and extending away from the base for installing the mounting block on the surface.

DETAILED DESCRIPTION OF THE PREFERRED EMBODIMENT

Figure 1:
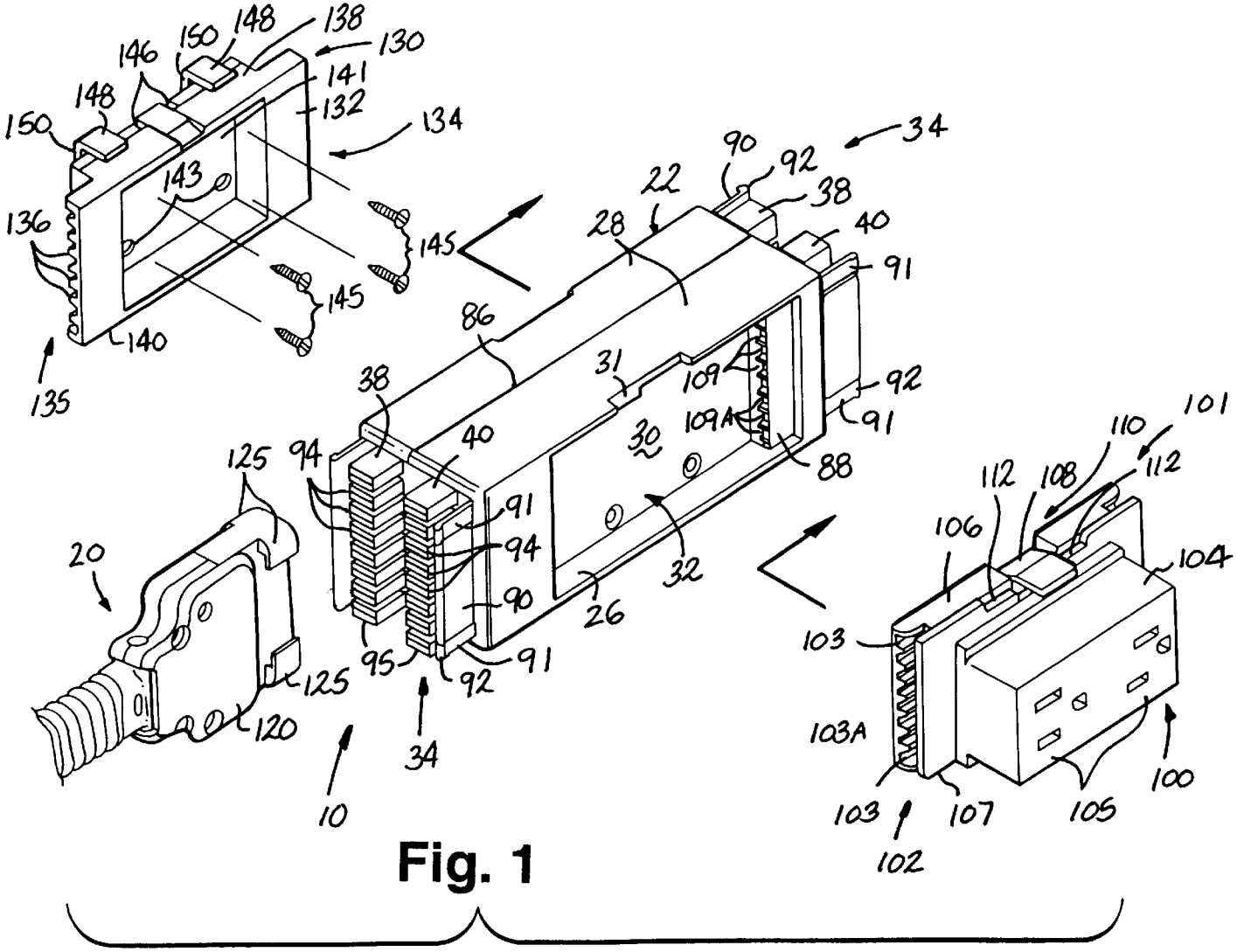
FIG. 1 is an exploded view of a mounting system for a junction block assembly and accompanying receptacle block according to the invention.
Figure 2:
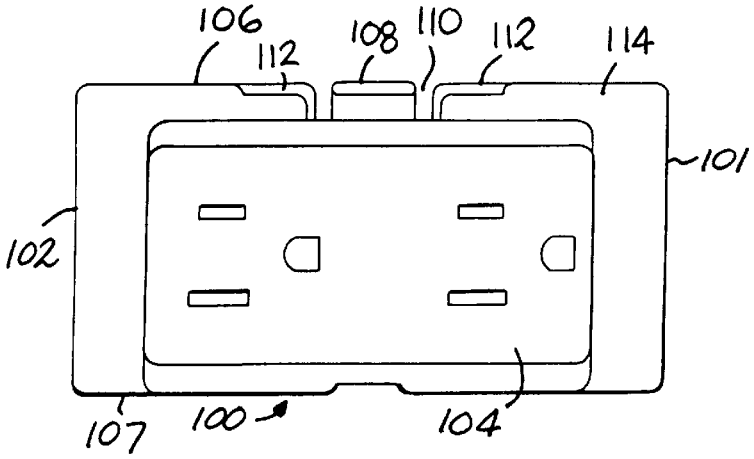
FIG. 2 is an enlarged side view of the receptacle block of FIG. 1.

As shown in FIG. 1, a junction block assembly 10 includes one or more power cable assemblies 20 and one or more electrical outlet receptacle blocks 100 (FIGS. 1 and 2). Receptacle blocks 100 provide power to electrical equipment (not shown) located in proximity thereto. Each junction block 22 includes a female connector block pair 34 at each end. Each female connector block pair 34 can be independently interconnected to one or more power cable assemblies 20, and are each provided with two columns 38, 40 of a plurality of female connector terminals for connection to male connector terminals of the power cable assemblies. Column 38 is electrically connected to column 40 in a similar manner as described in my U.S. Pat. No. 5,096,434. The junction block 22 has a lower wall 26, an upper wall 28 and a middle wall 30 which form an open spatial area 32 on each side of the junction block 22 (only one side of which is illustrated in FIG. 1). One female connector block pair 34 can be electrically connected to the other female connector block pair 34 of junction block 22 through internal wiring (not shown) in the junction block. It is to be noted that the two halves of junction block 22 as defined by a seam line 86 are identical and therefore a description with respect to one half of the junction block refers also to the other half.

A female receptacle connector 88 is located within each half of junction block 22 within open spatial area 32. A locking flange 31 extends downwardly from the upper wall 28 for engaging and holding and electrical outlet receptacle blocks 100. Electrical outlet receptacle blocks 100 are adapted to engage the female receptacle connectors 88 on each side of the junction block 22.

With further reference to FIG. 1, female connector block pairs 34 are each provided with a pair of side flanges 90 having upper and lower recessed areas 91, for engagement with flanges 125 of a male connector 120 which forms part of power cable assembly 20. Flanges 90 are made of a resilient plastic material and are provided with an outwardly extending inclined end surface 92. When end surfaces 92 of the side flanges 90 are engaged by flanges 125 of male connector 120, the side flanges 90 will be deflected inward, allowing flanges 125 to engage recess areas 91 to provide a mechanical locking engagement of the male and female connectors. The female connector block pairs 34 are each provided with two columns 38, 40 of a plurality of female connector terminals 94 and a key lug 95. The male connector 120 of cable assembly 20 is provided with a plurality of corresponding male connector terminal spaces (not shown) for reception of male connector terminals (not shown) and a key opening (not shown) for receiving key lug 95.

With reference now to FIGS. 1 and 2, an electrical outlet receptacle block 100 for connection to female receptacles 88 of junction block 22 is shown. Receptacle block 100 includes a first open end 101 and a second open end 102. First and second open ends 101, 102 include a plurality of terminal spaces 103 for the reception of male terminals 103A for connection with a plurality of female terminals 109A located within female terminal spaces 109 within the female receptacle connectors 88 on the junction block 22. An upper receptacle portion 104 of block 100 includes one or more receptacles 105 for receiving receptacle plugs (not shown) of electrically operated equipment. An upper wall 106 and lower wall 107 are spaced apart in order to provide a snug fit between upper wall 28 and lower wall 26 of the junction block. Receptacle 100 is provided with a spring latch 108 disposed in recess 110 in the upper wall 106 of receptacle 100. Upper wall 106 engages the upper wall 28 when the receptacle 100 is installed in the junction block. The locking flange 31 projecting from upper wall 28 will be aligned with recess 110 when the receptacle 100 is inserted between the upper and lower walls 28, 26, causing the spring latch 108 to be depressed. The receptacle 100 may then be moved to either the left or to the right (depending on which side of the junction block receptacle 100 is being installed) to engage one of the open ends 101, 102 such that male terminals 103A engage female terminals 109A within receptacle 88. Recesses 112 are provided in receptacle 100 to accommodate locking flange 31 on upper wall 28. Movement of the receptacle to either the left or the right by a sufficient distance will cause the spring latch 108 to be moved past locking flange 31, causing the spring latch 108 to return to its extended position. Hence, receptacle 100 will be retained in a locked position. The receptacle 100 may be removed by depressing spring latch 108 and sliding the receptacle 100 to either the left or right to align the locking flange 31 with recess 110.

Figure 3:
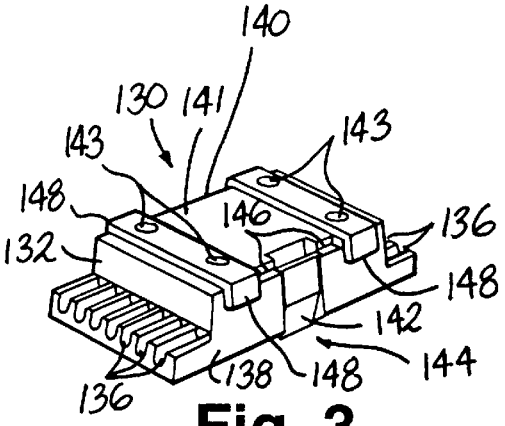
FIG. 3 is an enlarged orthographic view of the rear of the mounting system of FIG. 1.

For the purpose of releasably securing junction block 22 to a vertical mounting surface, and with reference to FIGS. 1 and 3, a mounting system 130 includes a mounting block 132 having a first end 134 and a second end 135. The first and second ends 134 and 135 include a plurality of male terminal spaces 136 for connection with a plurality of female terminal spaces 109 located within the female receptacle connectors 88 on the junction block 22. The male and female terminal spaces only mechanically interconnect, since the male terminal spaces 136 do not contain male terminals. An upper wall 138 and lower wall 140 are spaced apart in order to provide a snug fit between upper wall 28 and lower wall 26 of the junction block. A rear wall 141 extends between the upper and lower walls 138, 140 and the first and second ends 134, 135. A plurality of mounting holes 143 extend through the rear wall for the reception of screws 145, bolts, or the like for securing the mounting block to a vertical surface before receiving the junction block 22. Four L-shaped extensions 148 are integrally molded to or otherwise attached to the rear wall and extend outwardly therefrom. A space 150 is defined between a leg of each L-shaped extension and the upper or lower wall 138, 140. The space 150 is dimensioned to snugly receive the thickness of the upper or lower wall 28, 26 of the junction block 22 when the mounting block and junction block are secured to each other, for additional mechanical support. As with the receptacle 100, mounting block 132 is provided with a spring latch 142 disposed in recess 144 in the upper wall 138. The upper wall 138 engages the upper wall 28 when the junction block is attached to the mounting block 132. The locking flange 31 projecting from upper wall 28 will be aligned with recess 144 when the mounting block 132 is received between the upper and lower walls 28, 26, causing the spring latch 142 to be depressed. The junction block 22 may then be moved to either the left or to the right (depending on which side of the junction block is being mounted adjacent to the vertical surface) to engage one of the ends 134, 135 such that male terminal spaces 103 engage female terminal spaces 136 within receptacle 88. Recesses 146 are provided in mounting block 132 to accommodate locking flange 31 on upper wall 28. Movement of the junction block to either the left or the right by a sufficient distance will cause the spring latch 142 to be moved past locking flange 31, causing the spring latch 142 to return to its extended position. Hence, junction block 22 will be retained in a locked position with respect to the vertical surface. The junction block may be removed by depressing spring latch 142 and sliding the junction block 22 to either the left or right to align the locking flange 31 with recess 144.

Figure 5:
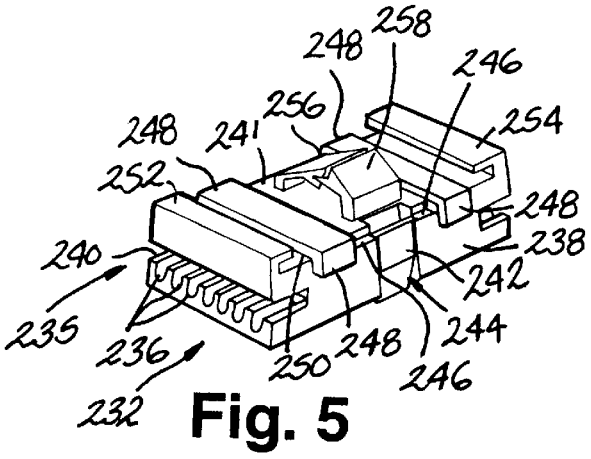
FIG. 5 is an enlarged orthographic view of the rear of the mounting system of FIG. 4.
Figure 4:
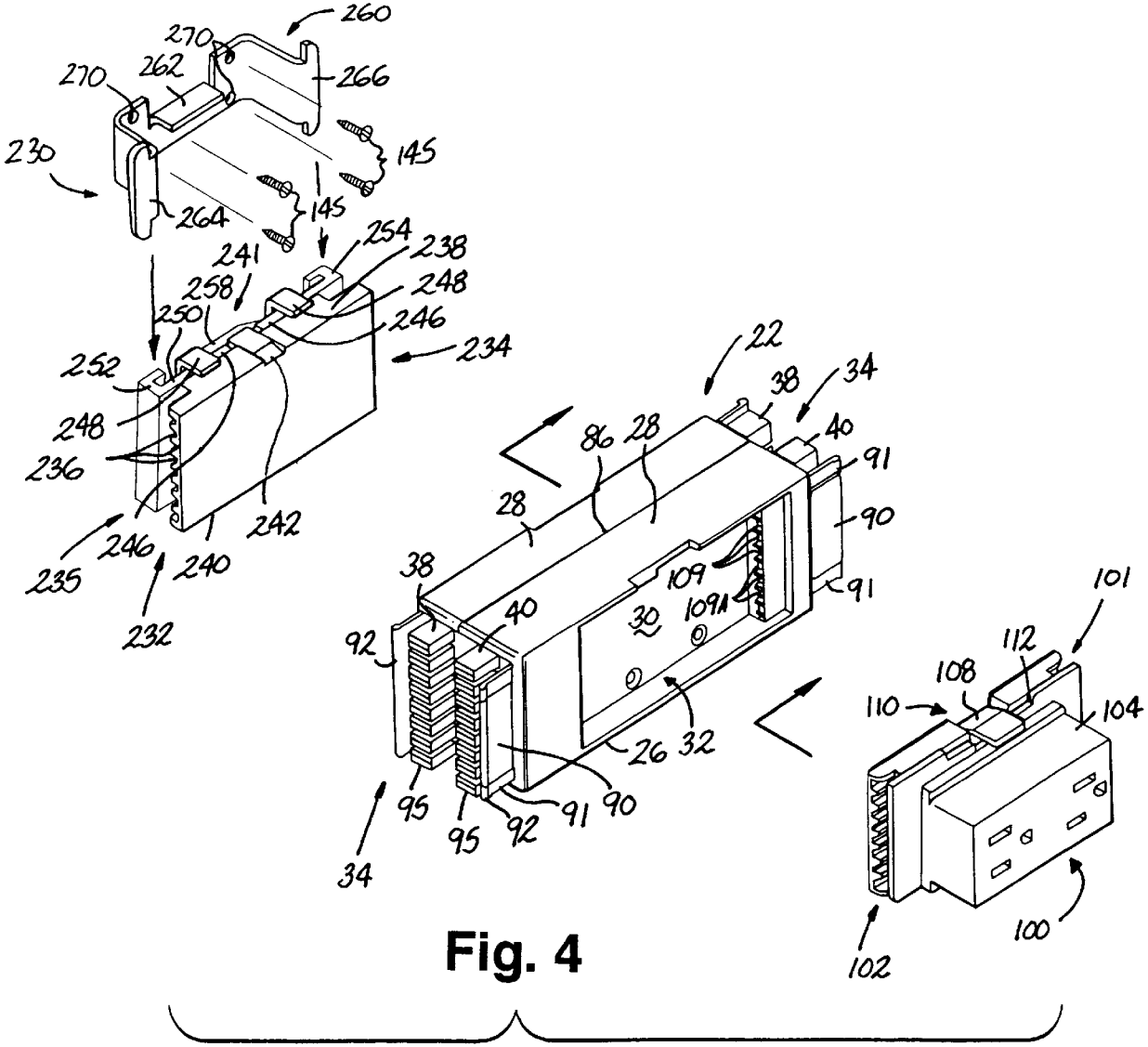
FIG. 4 is an exploded view of a mounting system for a junction block assembly and accompanying receptacle block according to a second embodiment of the invention.

Referring now to FIGS. 4 and 5, a mounting system 230 for a junction block assembly and accompanying receptacle block according to a second embodiment of the invention is shown, wherein like numerals in the previous embodiment are used to identify like parts in the present embodiment. The mounting system 230 includes a mounting block 232 and a mounting bracket 260. The mounting block 232 has a first end 234 and a second end 235. The first and second ends 234 and 235 include a plurality of male terminal spaces 236 for connection with a plurality of female terminal spaces 109 located within the female receptacle connectors 88 on the junction block 22 as in the previous embodiment. Again, the male terminal spaces 236 do not contain male terminals. An upper wall 238 and lower wall 240 are spaced apart in order to provide a snug fit between upper wall 28 and lower wall 26 of the junction block when the junction block is secured to the mounting block. A rear wall 241 extends between the upper and lower walls 238, 240 and the first and second ends 234, 235. A left L-shaped mounting lug 252, a right L-shaped mounting lug 254, and interlocking latch members 256, 258 are integrally mounted on or molded to the upper surface of the rear wall 241. A mounting bracket 260 includes a retaining tab 262, a left support bracket 264 and a right support bracket 266 formed integrally with a rear wall 268. A plurality of mounting holes 270 extend through the rear wall 268 for the reception of screws 145, bolts, or the like for securing the mounting bracket to a vertical surface before receiving the mounting block 232 and junction block 22. The mounting bracket is preferably constructed of metal, but may be constructed of other materials as well. After the mounting bracket is secured to a vertical surface, the mounting block 232 may be secured in position by engagement of the support brackets 264, 266 with the L-shaped mounting lugs 252, 254, respectively, and by engagement of the retaining tab 262 with the interlocking latch members 256, 258 in a similar manner as described in my U.S. Pat. No. 4,993,576 issued Feb. 19, 1991, the subject matter of which is incorporated herein by reference. Four L-shaped extensions 248 are integrally molded to or otherwise attached to the rear wall 241 of the mounting block and extend outwardly therefrom. A space 250 is defined between a leg of each L-shaped extension and the upper or lower wall 238, 240. The space 250 is dimensioned to snugly receive the thickness of the upper or lower wall 28, 26 of the junction block 22 when the mounting block and junction block are secured to each other, for additional mechanical support. As with the receptacle 100, mounting block 232 is provided with a spring latch 242 disposed in recess 244 in the upper wall 238. The upper wall 238 engages the upper wall 28 when the junction block is attached to the mounting block 232. The locking flange 31 projecting from upper wall 28 will be aligned with recess 244 when the mounting block 232 is received between the upper and lower walls 28, 26, causing the spring latch 242 to be depressed. The junction block 22 may then be moved to either the left or to the right (depending on which side of the junction block is being mounted adjacent to the vertical surface) to engage one of the ends 234, 235 such that male terminal spaces 103 engage female terminal spaces 236 within receptacle 88. Recesses 246 are provided in mounting block 232 to accommodate locking flange 31 on upper wall 28. Movement of the junction block to either the left or the right by a sufficient distance will cause the spring latch 242 to be moved past locking flange 31, causing the spring latch 242 to return to its extended position. Hence, junction block 22 will be retained in a locked position with respect to the mounting block 232. The junction block may be removed by depressing spring latch 242 and sliding the junction block 22 to either the left or right to align the locking flange 31 with recess 244. The mounting block 232 may also be removed from the mounting bracket 260 by depressing the interlocking latch members 256, 258 and sliding the support brackets 264, 266 out of the L-shaped mounting lugs 252, 254. It will be apparent that the junction block and mounting block may be secured together before attaching the mounting block to the mounting bracket.

Figure 6:
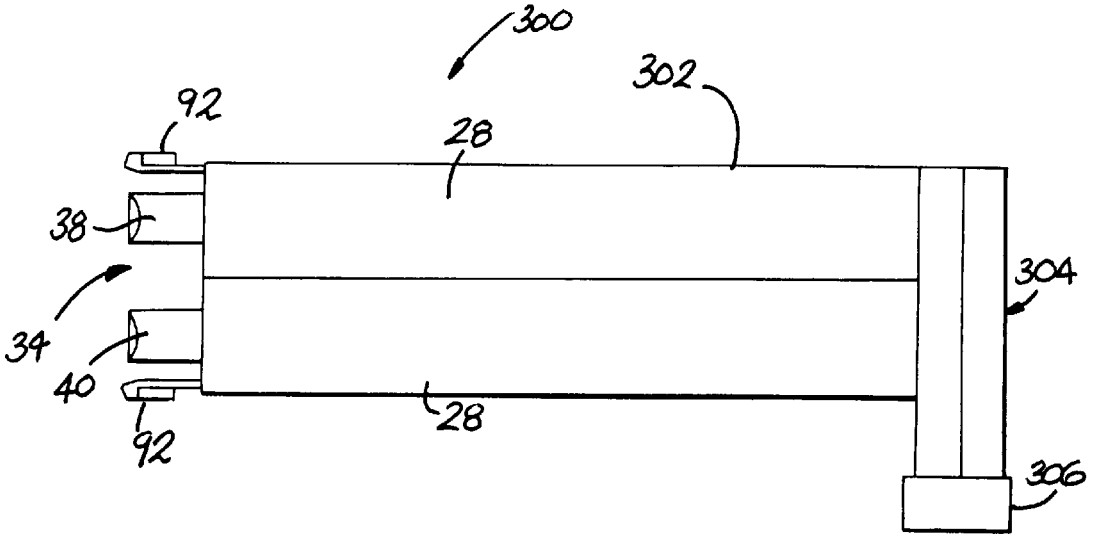
FIG. 6 is a top view of an L-shaped junction block for use with the mounting systems of the present invention.
Figure 7:
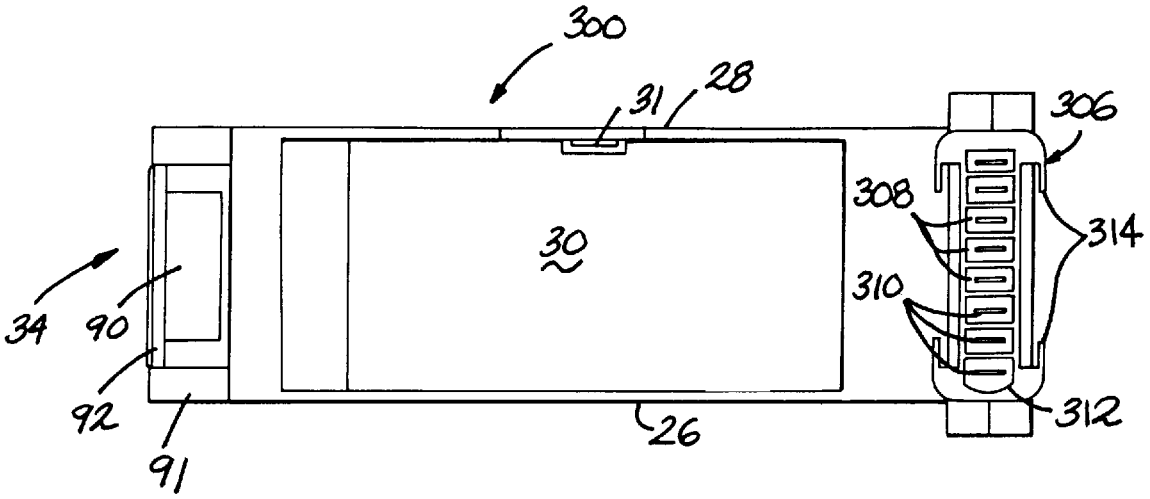
FIG. 7 is a side view taken along line 7—7 of FIG. 6 showing the end connection of the L-shaped terminal.

Referring now to FIGS. 6 and 7, there is shown an L-shaped junction block 300 having a junction block portion 302 substantially identical to junction block 22 previously described and therefore like elements are identified by like numerals. An arm 304 is integrally attached to junction block portion 302 and extends outwardly therefrom. The outward end of the arm 304 includes a male connector 306 similar to the male connector 120 associated with the cable assembly 20 previously described and includes a plurality of male connector terminal spaces 308 for reception of male connector terminals 310 and a key opening 312. Flanges 314 are provided on the male connector 306 and serve the same function as the flanges 125 on male connector 120. The male connector 306 is adapted for connection to a female connector block pair 34 of a junction block 22 having a key lug 95 and female terminals 94. This arrangement permits junction blocks to be extended around inside and/or outside corners of wall panels or other office furniture.

Figure 8:
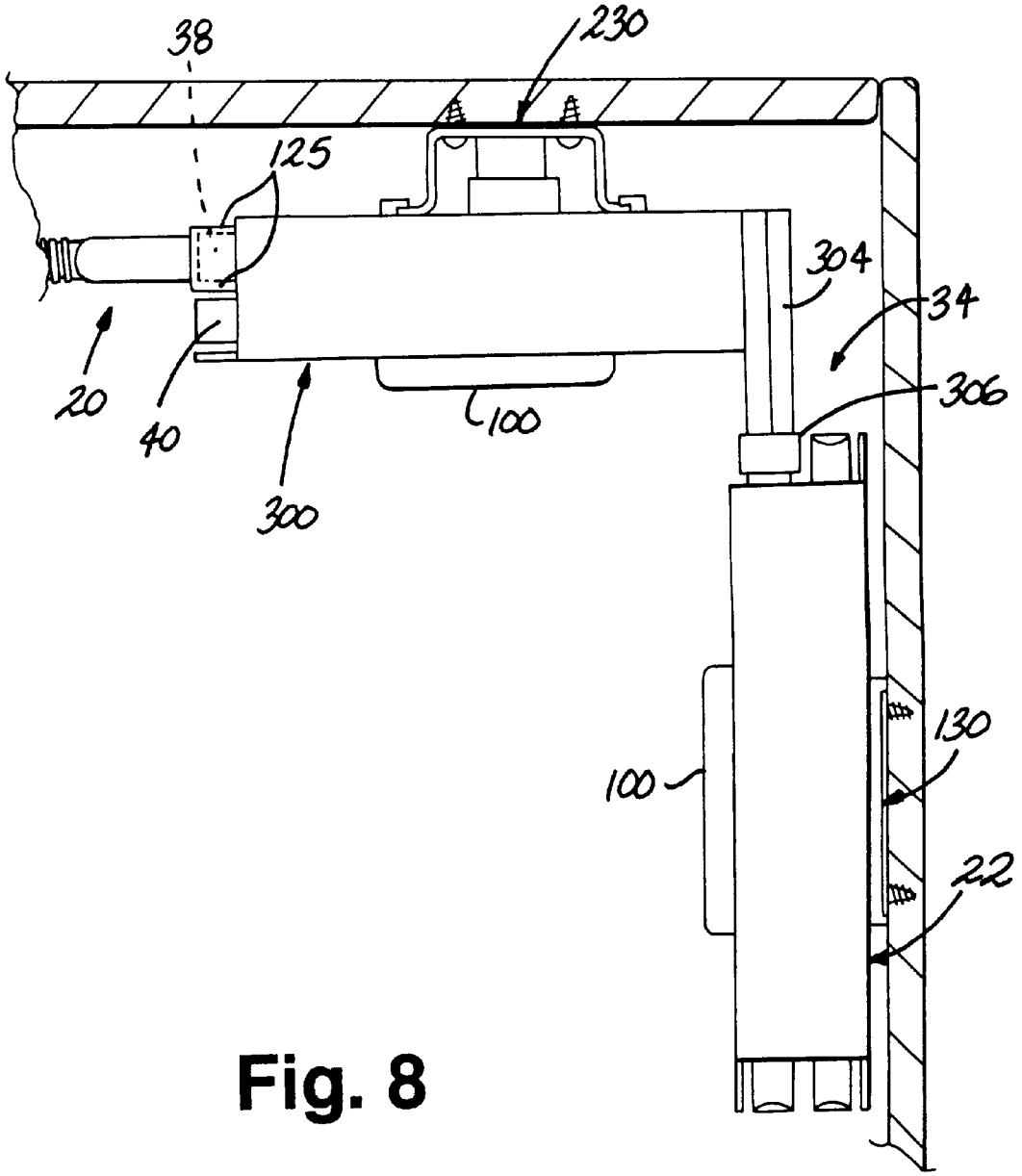
FIG. 8 is a top view of two junction blocks mounted around the inside corner of adjoining vertical surfaces through the mounting systems.
Figure 9:
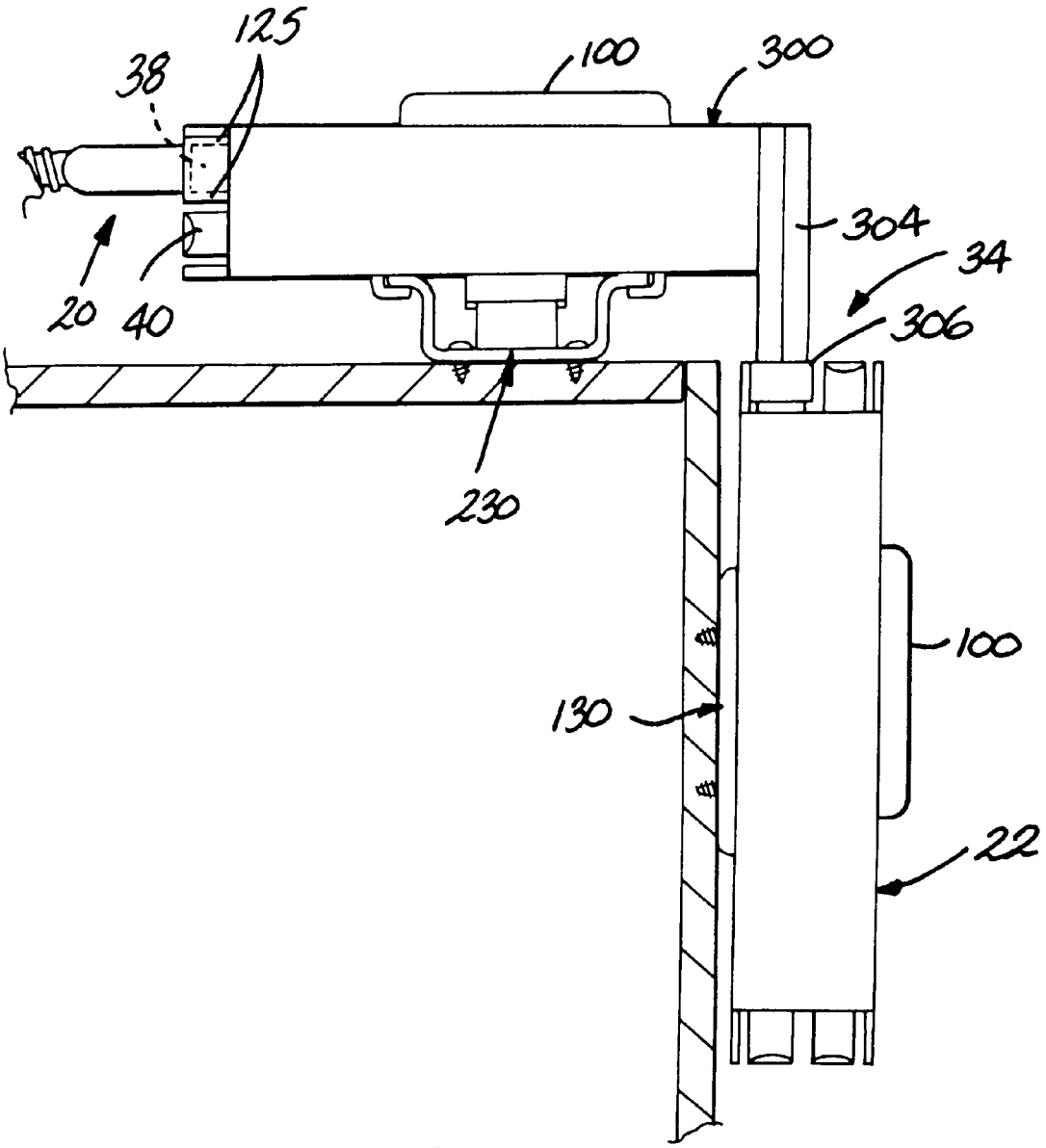
FIG. 9 is a top view of two junction blocks mounted around the outside corner of adjoining vertical surfaces through the mounting systems.

As shown in FIGS. 8 and 9, a first junction block 22 is attached to a second L-shaped junction block 300 through the male connector 306 and the connector block pair 34. In FIG. 8, the junction blocks are arranged to extend around an inside corner, and include a first mounting system 130 attached to the outside of junction block 22 and a second mounting system 230 attached to the outside of junction block 300. Likewise, in FIG. 9, the junction blocks are arranged to extend around an outside corner and include a first mounting system 130 attached to the inside of the junction block 22 and a second mounting system 230 attached to the inside of the junction block 300. The mounting systems 130 and 230 can be arranged on either side of the junction blocks, due to the identical arrangement of the two halves of the junction block 22 and the identical arrangement of the left and right sides of the mounting systems 130 and 230. Receptacle blocks 100 are mounted to the junction blocks opposite to the mounting systems for providing electrical power. It is to be noted that the mounting systems 130, 230 are interchangeable and may be used alone or in combination as illustrated in FIGS. 8 and 9.

While the invention has been described with reference to its preferred embodiment, it will be understood by those skilled in the art that various changes may be made and equivalents may be substituted for elements thereof without departing from the true spirit and scope of the invention. For example, although the mounting system of the present invention has been described for mounting a junction block to a vertical surface, it should be noted that the mounting system may be applied to horizontal surfaces of countertops, office furniture, ceilings, floors, etc.

What is claimed is:

1. An electrical interconnection assembly for use in distributing electrical power, the assembly being releasably securable to a surface of a wall, office furniture panel, or desk, said assembly comprising:

at least one modular electrical receptacle block having means for providing power to electrically operated equipment;

at least one junction block having duplicate opposing sides configured so that the at least one modular electrical receptacle block can be releasably and electrically connected to either of the opposing sides of the junction block, and electrical power can thereby be supplied from the junction block to the receptacle block;

a mounting assembly securable to the surface and comprising a structure separate from any modular electrical receptacle block, the mounting assembly having an absence of any means for electrical connection to either a junction block or any of the electrically operated equipment; and the mounting assembly and the junction block comprise means for mechanically and releasably securing the mounting assembly to either one of the opposing sides of the junction block, while the other one of the opposing sides of the junction block remains connectable to the at least one receptacle block.

2. An electrical interconnection assembly according to claim 1 wherein the mounting assembly comprises a mounting block having a base for connection to the junction block and a mounting portion attached to and extending away from the base for installing the mounting block on the surface.

3. An electrical interconnection assembly according to claim 2 wherein the modular electrical receptacle block comprises a base for connection to the junction block and an outlet receptacle portion attached to and extending away from the receptacle base for receiving an electrical plug from an electrically powered device.

4. An electrical interconnection assembly according to claim 3 wherein the mounting block base and the receptacle base are substantially similar in construction.

5. An electrical interconnection assembly according to claim 4 wherein each of the opposing sides of the junction block includes a recess, and the mounting block base and receptacle base are sized to be received within the recesses.

6. An electrical interconnection assembly according to claim 5 wherein each base includes a locking member and the junction block further comprises a locking flange adjacent each recess for holding the mounting block and modular receptacle in the recesses.

7. An electrical interconnection assembly according to claim 2 wherein the mounting portion of the mounting block comprises a wall that is integrally formed with the base, the wall being adapted for attachment to the surface.

8. An electrical interconnection assembly according to claim 7 wherein the wall has one or more apertures sized to receive fasteners for mounting the block to the surface.

9. An electrical interconnection assembly according to claim 2 and further comprising a mounting bracket for attachment between the surface and the mounting portion of the mounting block.

10. An electrical interconnection assembly according to claim 9 wherein the mounting bracket comprises a bracket wall with first and second spaced-apart support brackets and a retaining tab extending therefrom, the retaining tab being positioned between the first and second support brackets; and the mounting portion of the mounting block comprises first and second spaced-apart attachment lugs extending rearwardly of the base for slidably engaging the first and second support brackets, respectively; and a pair of opposing interlocking movable latch members hingedly attached to the base and defining therebetween a channel for receiving the retaining tab;

wherein each of the interlocking latch members is operable to disengage both of the latch members from the retaining tab in response to an external force on either of the latch members, whereby the retaining tab is disengaged from the latch members by operation of either latch member to allow sliding movement of the mounting block with respect to the mounting bracket.

11. An electrical interconnection assembly according to claim 10 wherein the bracket wall has one or more apertures sized to receive fasteners for mounting the bracket to the surface.

12. An electrical interconnection assembly in accordance with claim 1, characterized in that the junction block comprises a top wall and a bottom wall, and the duplicate opposing sides extend between the top and bottom walls, each of the opposing sides being adapted to lockably receive the at least one modular electrical receptacle block; and the mounting assembly comprises a mounting block having a base for connection to one of the junction block opposing sides and a mounting portion attached to and extending away from the base for installing the mounting block on the surface.

13. A mounting system according to claim 12 and further comprising a mounting bracket for attachment between the surface and the mounting portion of the mounting block.

14. A mounting system according to claim 13 wherein the mounting bracket comprises a bracket wall with first and second spaced-apart support brackets and a retaining tab extending therefrom, the retaining tab being positioned between the first and second support brackets; and the mounting portion of the mounting block comprises first and second spaced-apart attachment lugs extending rearwardly of the base for slidably engaging the first and second support brackets, respectively; and a pair of opposing interlocking movable latch members hingedly attached to the base and defining therebetween a channel for receiving the retaining tab;

wherein each of the interlocking latch members is operable to disengage both of the latch members from the retaining tab in response to an external force on either of the latch members, whereby the retaining tab is disengaged from the latch members by operation of either latch member to allow sliding movement of the mounting block with respect to the mounting bracket.

15. A mounting system according to claim 14 wherein the bracket wall has one or more apertures sized to receive fasteners for mounting the bracket to the surface.

16. An electrical interconnection assembly according to claim 1, wherein said at least one junction block comprises:

a first junction block portion comprising a top wall, a bottom wall and said duplicate opposing sides; and an arm attached to said first junction block portion and extending outwardly therefrom, said arm comprising electrical connectors extending substantially perpendicular or otherwise angled at an acute angle relative to the planes of said duplicate opposing sides.

17. An electrical interconnection assembly according to claim 16 and further comprising a second junction block electrically interconnected to said at least one junction block through said arm.

18. An electrical interconnection assembly for use in distributing electrical power, the assembly being releasably securable to a surface of a wall, office furniture panel, or desk, the assembly comprising:

at least one modular electrical receptacle block having means for providing power to electrically operated equipment;

at least one junction block having opposing sides configured so that the modular electrical receptacle block can be electrically connected to either of the opposing sides of the junction block, and electrical power can thereby be supplied from the junction block to the receptacle block;

a mounting assembly securable to the surface and comprising a structure separate from any modular electrical receptacle block, the mounting assembly having an absence of any means for electrical connection to either a junction block or any of the electrically operated equipment;

mechanical connection means associated with the modular electrical receptacle block, junction block and mounting assembly so that the at least one modular electrical receptacle block can be mechanically and releasably connected to either of the opposing sides of the junction block, and the mounting assembly can be mechanically and releasably connected to either of the opposing sides of the junction block; and the mechanical connection means is structured so that the mechanical interconnection between the at least one modular electrical receptacle block and either of the opposing sides of the junction block is substantially the same as the mechanical interconnection between the mounting assembly and either of the opposing sides of the junction block.

19. An electrical interconnection assembly according to claim 18 characterized in that the mounting assembly comprises a mounting block having a base for connection to the junction block, and a mounting portion attached to and extending away from the base for installing the mounting block on the surface.

20. An electrical interconnection assembly according to claim 18 characterized in that the modular electrical receptacle block comprises a base for connection to the junction block and an outlet receptacle portion attached to and extending away from the receptacle base for receiving an electrical plug from an electrically powered device.

21. An electrical interconnection assembly according to claim 20 wherein the mounting block base and the receptacle base are substantially similar in construction.

22. An electrical interconnection assembly according to claim 21 wherein each of the opposing sides of the junction block includes a recess, and the mounting block base and receptacle base are sized to be received within the recesses.

23. An electrical interconnection assembly according to claim 22 wherein each base includes a locking member and the junction block further comprises a locking flange adjacent each recess for holding the mounting block and modular receptacle in the recesses.

24. An electrical interconnection assembly according to claim 19 wherein the mounting portion of the mounting block comprises a wall that is integrally formed with the base, the wall being adapted for attachment to the surface.

25. An electrical interconnection assembly according to claim 24 wherein the wall has one or more apertures sized to receive fasteners for mounting the block to the surface.

* * * * *